US006202848B1

(12) United States Patent
Tindoll et al.

(10) Patent No.: US 6,202,848 B1
(45) **Date of Patent: *Mar. 20, 2001**

(54) COLLAPSIBLE CORNER PROTECTOR

(75) Inventors: Avalon Tindoll; Stanley Hendrix, both of Tupelo; Brian P. Tindoll; J. Scott Tindoll, both of Saltillo, all of MS (US)

(73) Assignee: Manufacturer's Equipment & Supply Company, Inc., Tupelo, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,123

(22) Filed: May 10, 2000

Related U.S. Application Data

(63) Continuation of application No. 09/295,384, filed on Apr. 21, 1999, now Pat. No. 6,070,727, and a continuation of application No. 09/534,401, filed on Mar. 24, 2000.

(51) Int. Cl.[7] ..... B65D 81/05
(52) U.S. Cl. ..... 206/522; 206/523; 206/586
(58) Field of Search ..... 206/453, 522, 206/586; 383/105, 107, 907; 248/345.1; 428/34.1, 35.2

(56) References Cited

U.S. PATENT DOCUMENTS

| | | | | |
|---|---|---|---|---|
| 1,157,568 | * | 10/1915 | Mills | 383/907 |
| 2,324,031 | | 7/1943 | Schiffenhaus . | |
| 2,476,197 | | 7/1949 | Kincaid . | |
| 2,536,834 | * | 1/1951 | Baker et al. | 383/907 |
| 2,728,451 | * | 12/1955 | Leander | 206/453 |
| 3,003,681 | * | 10/1961 | Orsini | 383/907 |
| 3,137,087 | | 6/1964 | Shroyer . | |
| 3,144,236 | | 8/1964 | Clanin . | |
| 3,220,683 | | 11/1965 | Doll . | |
| 3,428,167 | * | 2/1969 | Sheng | 150/154 |
| 3,511,464 | | 5/1970 | Doll . | |
| 3,762,626 | | 10/1973 | Dorsey . | |
| 3,948,436 | * | 4/1976 | Bambera | 206/523 |
| 3,973,720 | | 8/1976 | Schmid . | |
| 4,192,423 | | 3/1980 | Rekow . | |
| 4,529,091 | | 7/1985 | Martin . | |
| 5,351,829 | | 10/1994 | Batsford . | |
| 5,695,058 | * | 12/1997 | Dellecker | 383/907 |
| 5,738,893 | * | 4/1998 | Kornet et al. | 383/907 |
| 5,862,914 | | 1/1999 | Farison et al. . | |
| 6,012,579 | | 1/2000 | Tindoll et al. . | |
| 6,070,727 | | 6/2000 | Tindoll et al. . | |

* cited by examiner

*Primary Examiner*—Jim Foster
(74) *Attorney, Agent, or Firm*—Young & Thompson

(57) ABSTRACT

A corner protector comprises two sheets of superposed material joined along two straight edges that meet at an angle of 135°. It is open along any other edge. The sheets are swingable relative to each other about the joined edges, whereby when the sheets are swung about the joined edges until the two edges are at a right angle to each other, a corner protector is produced which has three flat sides each of which meets the other two sides at a right angle. In another embodiment, the two superposed sheets of material each have five edges, the edges of the sheets being joined together along four sides but free from each other along a fifth side, a first and second side meeting each other at an angle of 135°, a second and third side meeting each other at an angle of 90°, and a third and fourth side meeting each other at an angle of 135°, whereby the corner protector has an axis of symmetry parallel to the first and fourth sides, thereby to provide mirror image halves of the protector on opposite sides of that axis, so that when one half is everted and inserted into the other half, a corner protector as first recited is produced.

6 Claims, 5 Drawing Sheets

COLLAPSIBLE CORNER PROTECTOR

RELATED CASES

This application is a continuation of our applications Ser. No. 09/295,384, filed Apr. 21, 1999, U.S. Pat. No. 6,070,727, and Ser. No. 09/534,401, filed Mar. 24, 2000, pending.

FIELD OF THE INVENTION

The present invention relates to a protector for the corners of objects which are generally parallelepipedal, which protector is nevertheless collapsible to lie flat.

BACKGROUND OF THE INVENTION

Corner protectors for parallelepipedal materials such as boxes and the like are known, which are fitted to the shape of the corner to be protected and hence easily slip over that corner.

Such corner protectors offer excellent protection from potentially damaging forces applied in any direction to the material of the corner. However, such corner protectors are difficult to manufacture and assemble, and, because they match the bulk of the corner to be protected, and hence are bulky and difficult to store.

OBJECTS OF THE INVENTION

It is accordingly an object of the present invention to provide a corner protector for parallelepipedal material, which can be stored in a flattened condition in which it occupies relatively little space, but which can be easily erected to match the shape of a corner to be protected.

It is another object of the present invention to provide such a corner protector, which, when flattened, can have either two or four thicknesses of material and which, when erected, can have either one or two thicknesses of material, thereby to provide more or less protection from impact.

Still another object of the present invention is to provide such corner protectors, which can be sold in rolls of strip of any length which can be torn off one by one from such a strip.

Finally, it is an object of the present invention to provide such a corner protector, which is simple and inexpensive to manufacture from a minimum of material.

SUMMARY OF THE INVENTION

The invention is the discovery that the objects of the invention, recited above, can be achieved by providing a corner protector formed from two superposed sheets of protective material, with seams or fold lines along two edges that join at an angle of 135°, any other side or sides of the superposed sheets being open.

When the corner protector is erected, one seam extends along an edge of the object to be protected and the other seam or fold line lies flat in the plane of a major face of the protected object and at a 45° angle from two protected edges of the protected object.

In this way, a corner protector can be simply and quickly and easily formed, by folding or seaming a flat material with cushioning properties to provide a generally quadrilateral envelope with at least one side open and an obtuse apex opposite that open side or sides.

When the corner protector is erected from its flattened condition, by bringing the two seams toward each other until they are at right angles to each other, there is naturally formed a corner protector which has substantially the same shape as the corner to be protected. In this erected condition, one seam of the protector extends diagonally across one side of the erected protector whilst the other seam separates the other two sides of the erected protector, which other two sides are disposed at a right angle to each other and to the first-mentioned side bearing the diagonally extending seam. A three-sided erected protector is thus provided, all sides of which are at right angles to each other.

It is preferred th at, opposite the two joined seams that meet at an angle of 135°, there are two open sides disposed one at a right angle to its adjacent seam and the other at an angle of 45° to its adjacent seam, the two open sides being disposed at 90° to each other and being straight, with one open side parallel to a closed or seamed side or edge of the protector, the two parallel sides of the protector being separated by an open side which is perpendicular to both of the parallel sides.

The corner protector described above, when flattened, is of two thicknesses but when erected is of a single thickness.

In another embodiment, a corner protector with four thicknesses when flattened and two thicknesses when erected can be provided, by providing a device which is effectively the enantiomer of the first-mentioned device, which is to say that one half of this latter device is the mirror image of the other half. The resulting object is five sided, two of the sides being parallel and meeting two other sides at angles of 135°, those other s ides meeting each other at a right angled apex, the side opposite the apex being open and the other four sides being closed. When this latter device is partially everted, that is, turned inside out, with one half inserted into the other half, a device which overall resembles the first-mentioned embodiment is produced, but which has twice as many thicknesses.

A strip of devices according to the first embodiment can be provided, in which the diagonal sides abut and are separably joined to each other and in which the open sides abut and are separably joined to each other, which is to say that the devices are alternately reversed in the strip, so that they may easily be torn off from, say, a roll of the strip. This is both a convenient packaging and a convenient dispensing arrangement for the devices.

BRIEF DESCRIPTION OF THE DRAWINGS

Other objects, features and advantages of the present invention will become apparent from a consideration of the following description, taken in connection with the accompanying drawings, in which.

DETAILED DESCRIPTION OF THE INVENTION

Figure 1:
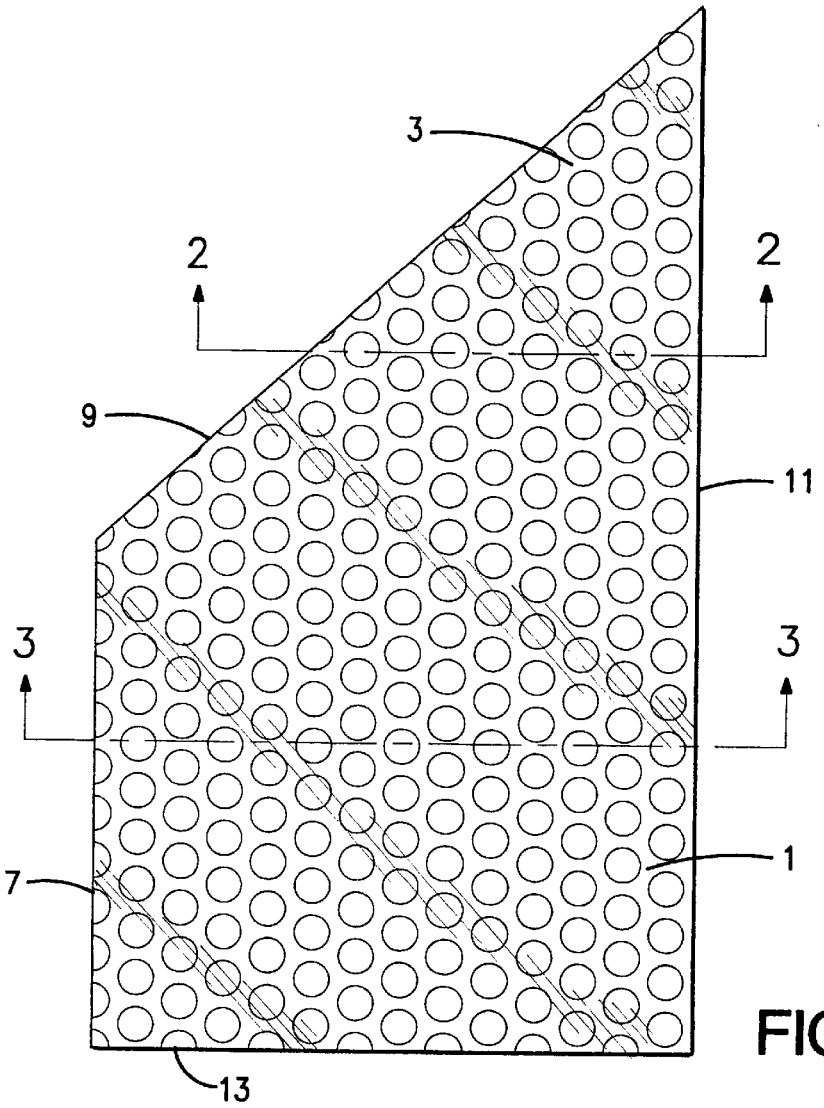
FIG. 1 is an elevational view of a corner protector for sheet material, according to a first embodiment of the invention, shown in its flattened condition.
Figure 2:
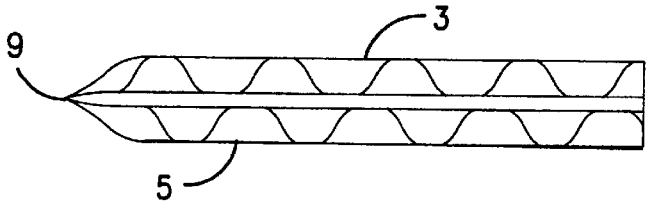
FIG. 2 is an enlarged fragmentary cross-sectional view taken on the line 2—2 of FIG. 1.
Figure 3:
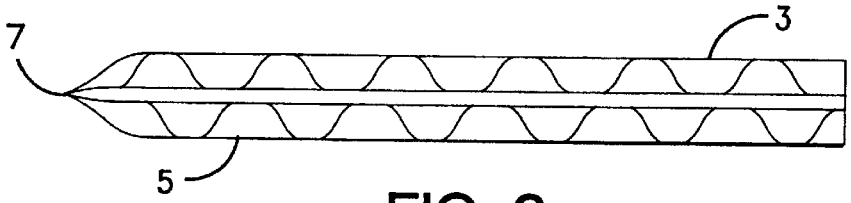
FIG. 3 is an enlarged cross-sectional view taken on the line 3—3 of FIG. 1.
Figure 4:
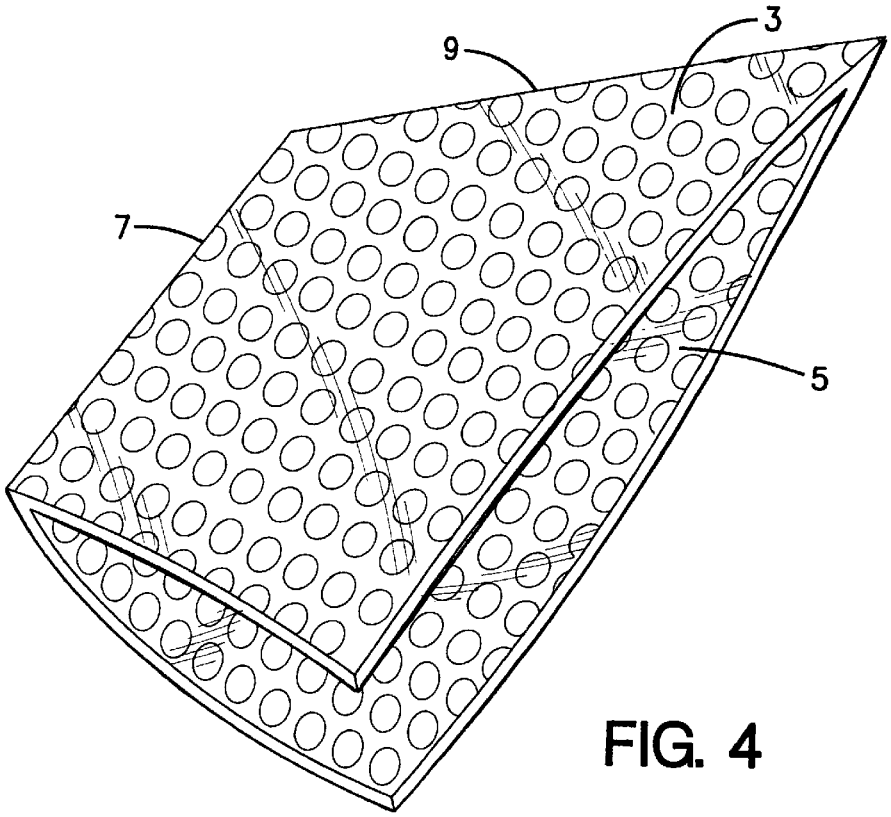
FIG. 4 is a perspective view of the embodiment of FIG. 1, viewed from the open side or sides.

Referring to the drawings in greater detail, and first to the embodiment shown in FIGS. 1–6 thereof, there is shown in FIG. 1 a corner protector 1 according to a first embodiment of the present invention, comprising a pair of superposed sheets 3 and 5 of protective material, such as plastic foam or plastic bubble sheet, preferably air bubble plastic.

The two sheets 3 and 5 are joined together along two edges 7 and 9, leaving an envelope that is open at what is a side edge 11 in FIG. 1 and a bottom edge 13 in FIG. 1. The edges 7 and 9 are preferably formed by heat welding the free edges of two sheets 3 and 5 together; but this can also be achieved by gluing. Also, one of the edges 7 or 9 can be formed by folding over identical mirror image halves of the protector, each half constituting one of the sheets 3 and 5, thereby to form a folded edge about which the material of the corner protector is continuous.

The two edges 7 and 9 form an obtuse angle of 135° with each other. The edge 9 forms an angle of 45° with edge 11 and edge 13 forms right angles with edges 7 and 11. The shape and arrangement of edges 11 and 13, however, can be other than shown. The illustrated arrangement of those edges is preferred for ease of manufacture; but it is to be understood that edges 11 and 13 could instead have other shapes and could be one continuous arcuate edge.

Figure 5:
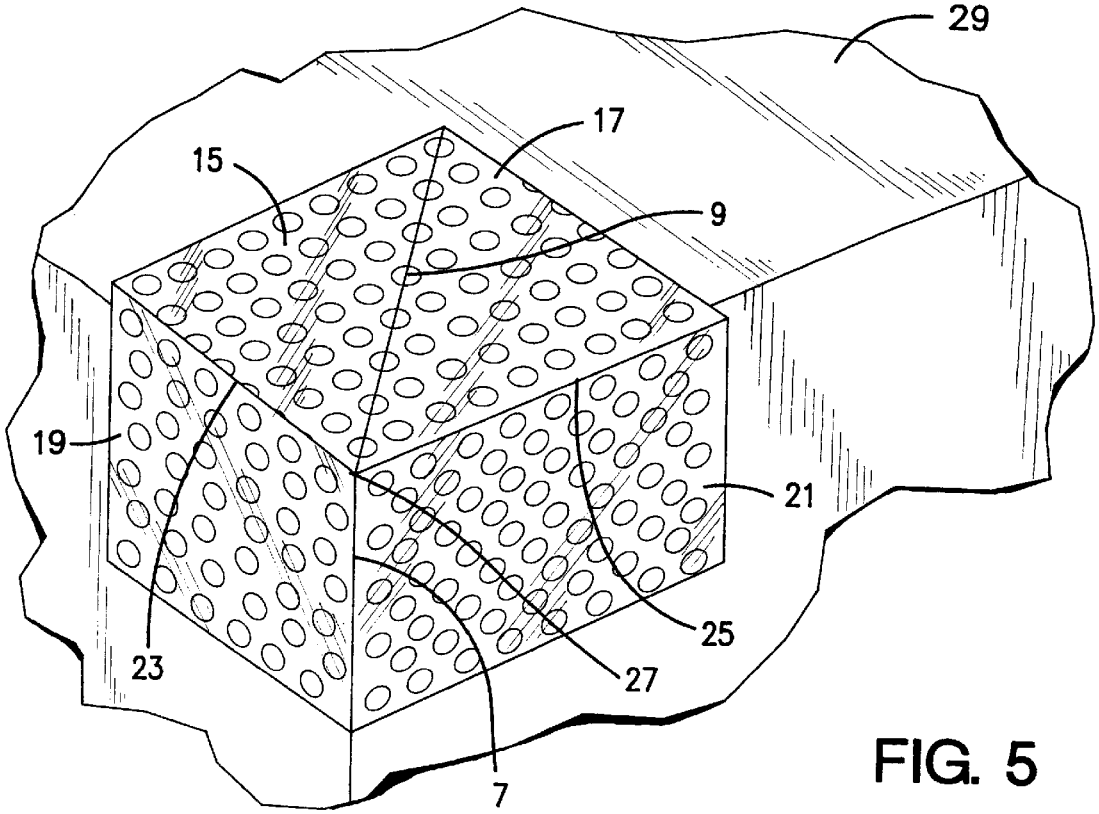
FIG. 5 is a perspective view of a corner protector according to the first embodiment of the invention, in fully erected condition, showing a protected corner in place therein.

FIG. 5 of the drawings shows the corner protector in erected condition, wherein the edges 7 and 9 have been brought toward each other into a right angular relationship with each other. In this erected condition, the protector will have three sides: a large flat side formed by portions 15 and 17 of sheets 5 and 3, respectively, on opposite sides of edge 9, and two new sides 19 and 21 contiguous to edge 11 and perpendicular to each other and at right angles to the portions 15 and 17, sides 19 and 21 being formed respectively from sheets 5 and 3. Notice that portions 15 and 17 are flat and coplanar.

Two new edges 23 and 25 will thus be formed, which come to a point at 27 which is the common juncture of edges 23, 25, 7 and 9, this point overlying a corresponding point of the object 29 to be protected and the edges 23, 25 and 7 overlying corresponding edges of the object 29 to be protected, all of which edges, both of the corner protector and of the object to be protected, are perpendicular to each other, as are the sides of the object 29 that meet at the protected corner.

Figure 6:
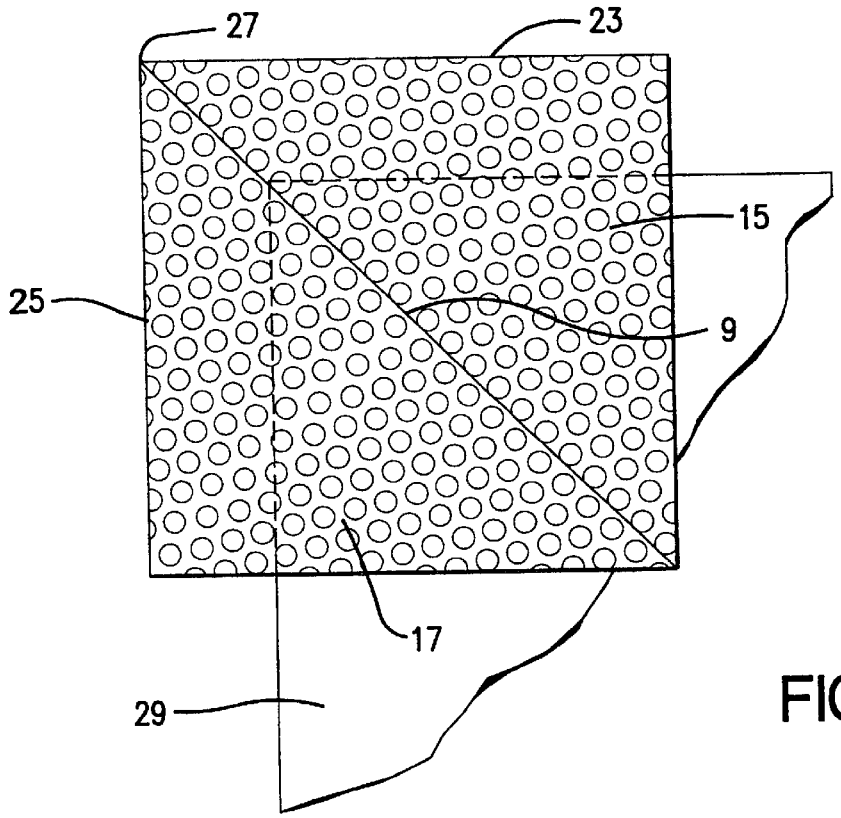
FIG. 6 is a top plan view showing a protected corner partially inserted in a fully erected corner protector according to the first embodiment of the invention.
Figure 7:
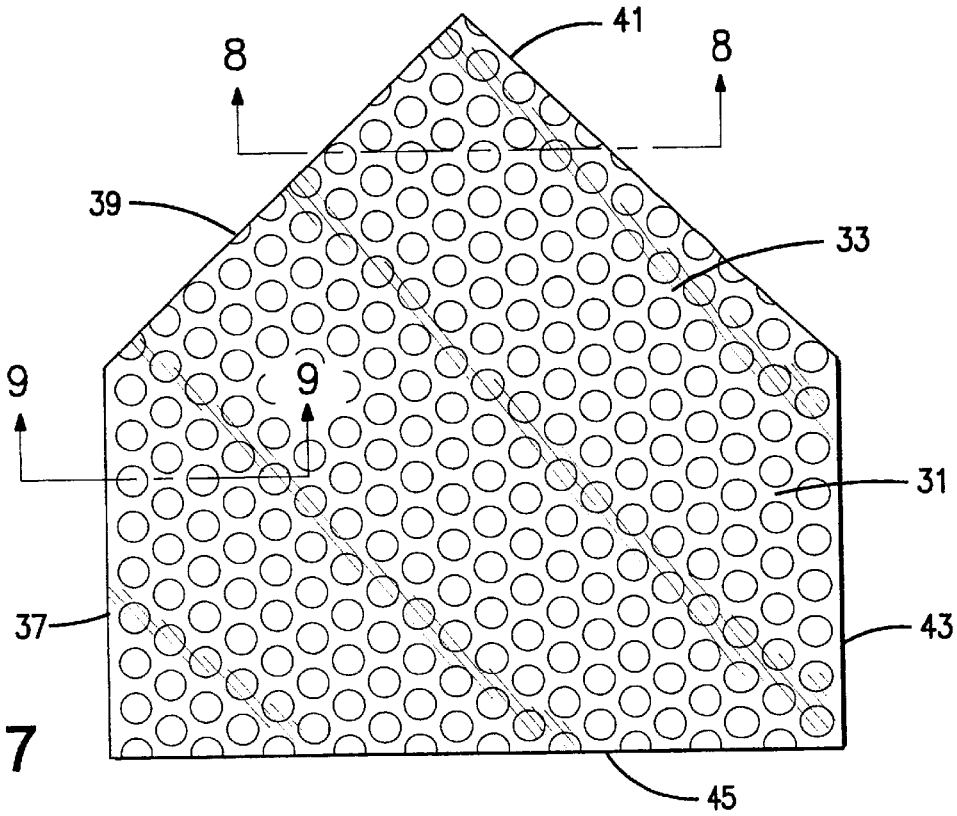
FIGS. 7–10 are views similar to FIGS. 1–4, respectively, but showing a second embodiment of corner protector according to the present invention.
Figure 8:
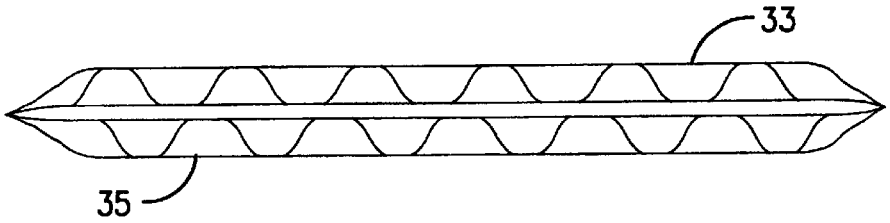
Figure 9:
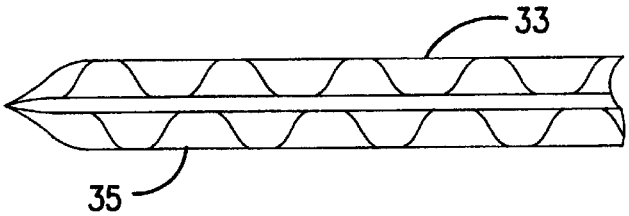
Figure 10:
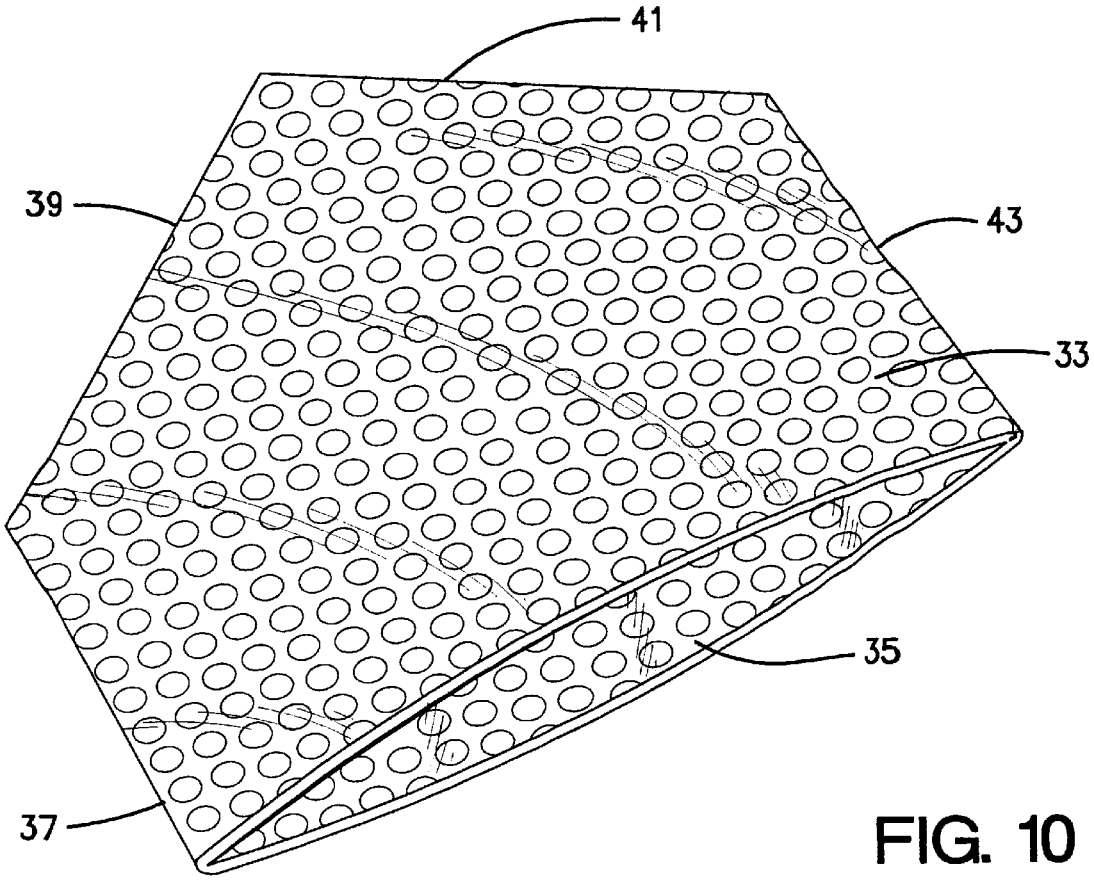
Figure 11:
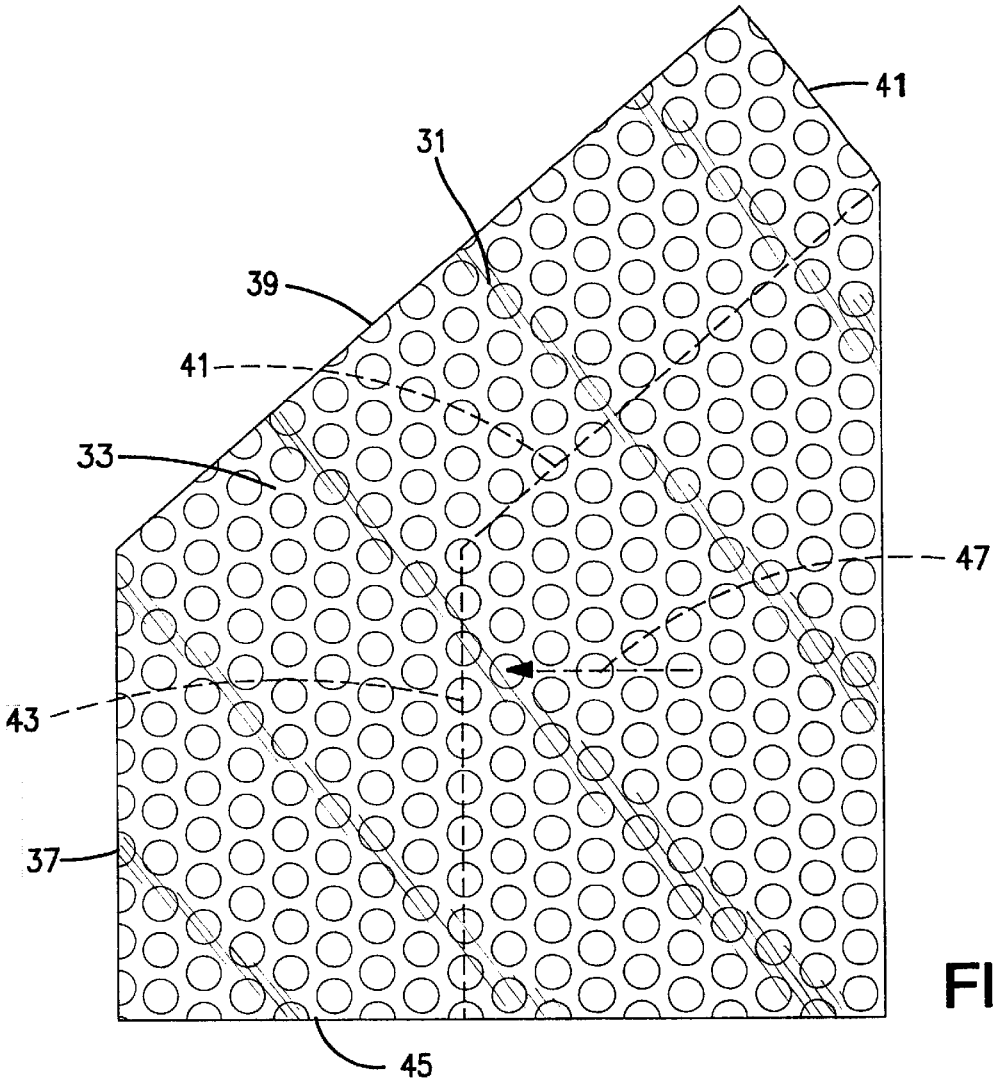
FIG. 11 is a view similar to FIG. 7 but showing the corner protector of the second embodiment partially everted.

FIG. 6 shows a further view of the corner protector and the protected corner, in partially assembled condition, thereby more clearly to illustrate the relationship between the respective edges and sides.

FIGS. 7–10 correspond to FIGS. 1–4, respectively, showing the first embodiment of the invention, but show a second embodiment of corner protector when it is desired to double the protective thickness of the protector. Thus, in the flattened condition, the protector of FIG. 1 has two superposed thicknesses and in erected condition has only one thickness. By contrast, in flattened condition, the protector shown in FIGS. 7–11 will have two thicknesses; but in an intermediate state it will have four thicknesses and in the erected or protective condition, it will have two protective thicknesses superposed on each other.

Thus, the corner protector of FIGS. 7–11, shown at 31, is comprised by two superposed sheets 33 and 35 joined along edges 37, 39, 41 and 43 and open along edge 45. Edges 37 and 39 form an angle of 135° with each other. Edge 39 forms a 90° angle with edge 41. Edges 41 and 43 form an angle of 135° with each other, and open edge 45 is at right angles to and joins edges 37 and 43.

The corner protector of FIGS. 7–11 is erected in two steps:

In a first step, one of the edges 37 or 43 is brought toward the other edge 43 or 37 by eversion of one half of the protector into the other half. Notice that the two halves of the protector are mirror images of each other about an axis of symmetry passing through the intersection of edges 39 and 41 and perpendicular to and bisecting the edge 45, this axis of symmetry also being parallel to the edges 37 and 43. Thus, when one symmetrical half is everted and inserted into the other symmetrical half, as is for example shown at an 5 intermediate stage in FIG. 11, by movement of the edge 43 toward the edge 37 in the direction of the arrow 47, or vice versa in the opposite direction, and this eversion is completed so that the everted half is fully tucked into the other half, a device will be produced which resembles that of FIGS. 1–6 but which has twice the thickness. The erection and installation of this second embodiment on a protected corner is thus identical to that of the first embodiment but the protective thickness is twice as great.

Figure 12:
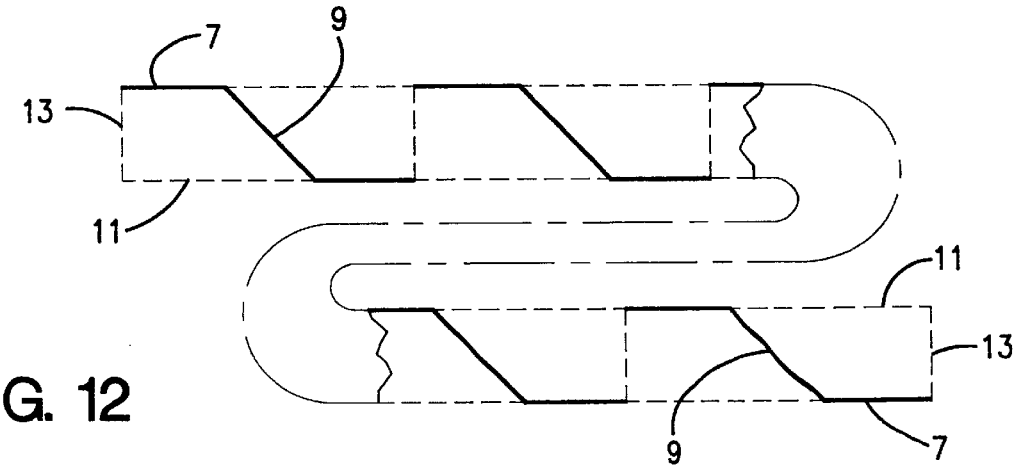
FIG. 12 is a diagrammatic view of a continuous strip of corner protectors according to the first embodiment of the invention.

FIG. 12 shows how a device according to the first embodiment of FIGS. 1–6 can be conveniently produced, stored, shipped and dispensed one by one from a roll of an indefinite length of strip whose edges are parallel to each other. In the strip shown in FIG. 12, the closed edges 7 and 9 are shown in full line and the open edges 11 and 13 in broken line. An edge 13 of one device is separably joined to an edge 13 of the adjacent device by a line of weakness such as a perforated line. A closed edge 9 of each device is separably joined to a closed edge 9 of the adjacent device in the strip, along a further line of weakness which is in addition to the heat sealed or cemented lines which close the edges 9. The alternating closed edges 7 and the open edges 11 form the longitudinal edges of the strip.

Thus, as a corner protector is needed, the line of weakness at edges 13 or edges 9 is torn open, thereby to release a device as in FIG. 1. The devices will ordinarily be manually applied to the corners to be protected, and so the fact that the devices are alternately reversed will not confuse the worker who applies the devices.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand.

What is claimed is:

1. A corner protector comprising two sheets of superposed material joined along two straight edges that meet at an angle of 135°, said protector being open along any other edge, said sheets being swingable relative to each other about said joined edges, whereby when said sheets are swung about said joined edges until said two edges are at a right angle to each other, a corner protector is produced which has three flat sides each of which meets the other two sides at a right angle.

2. A corner protector as claimed in claim 1, which is quadrilateral and which has, in addition to said two straight edges, two more straight edges that are connected to each other and that meet at an angle of 90° and that meet the first-mentioned said edges respectively at angles of 90° and 45°.

3. A corner protector as claimed in claim 1, which when flattened is of two thicknesses of said superposed material.

4. A corner protector as claimed in claim 1, which when flattened is of four thicknesses of said superposed material.

5. A corner protector comprising two sheets of superposed material each having five edges, the edges of said sheets being joined together along four said sides but free from each other along a fifth said side, a first and second of said four sides meeting each other at an angle of 135°, a second and third of said four sides meeting each other at an angle of 90°, and a third and fourth of said four sides meeting each other at an angle of 135°, said fifth side meeting said first and fourth sides at angles of 90°, whereby said corner protector has an axis of symmetry parallel to said first and fourth sides, thereby to provide mirror image halves of said protector on opposite sides of said axis, whereby when one said half is everted and inserted into the other said half, a corner protector as claimed in claim 1 is produced.

6. A strip having two straight parallel edges and comprised by a repeating series of a plurality of corner protectors each of which is according to claim 2, arranged in alternately opposite orientation along said strip and detachably connected together.

* * * * *